United States Patent [19]

Stahler et al.

[11] 4,432,230

[45] Feb. 21, 1984

[54] METHOD AND APPARATUS FOR CALIBRATING PUMPS

[76] Inventors: John A. Stahler, 609 Maple La., Elk Grove; Takashi Yamaguchi, 875 Tree La., Prospect Heights, both of Ill. 60070

[21] Appl. No.: 381,799

[22] Filed: May 25, 1982

[51] Int. Cl.[3] ..... G01M 19/00; G01F 25/00

[52] U.S. Cl. ..... 73/168; 73/3

[58] Field of Search ..... 73/168, 3

[56] References Cited

U.S. PATENT DOCUMENTS

| | | | |
|---|---|---|---|
| 2,329,042 | 9/1943 | Fuller | 73/3 |
| 3,125,879 | 3/1964 | Porter | 73/3 |
| 3,226,973 | 1/1966 | Evans et al. | 73/3 |

OTHER PUBLICATIONS

Brooks Vol-U-Meter-Design Specifications, a Publication of Brooks Instrument Div., Emerson Elec. Co., Hatfield, Pa., 19440, Jul. 1979.

*Primary Examiner*—S. Clement Swisher

[57] ABSTRACT

A method and apparatus are disclosed for calibrating the flow rate of a pump. The apparatus includes a high pressure pump, a critical flow orifice and a receptacle or air bag. The high pressure pump pumps a fluid, such as air, through the orifice into the receptacle at pressure sufficient to maintain the flow rate past the orifice in the critical region wherein flow rate is essentially independent of pressure. The receptacle is filled for a precisely determined time thereby providing a known amount of air in the receptacle. Through a valving arrangement the receptacle is then evacuated by the pump to be calibrated and the time required to evacuate the receptacle is determined. This permits calibration of the flow rate of the pump under test. An electronic circuit including a microprocessor automatically performs the timing functions and flow rate calculations.

14 Claims, 6 Drawing Figures

METHOD AND APPARATUS FOR CALIBRATING PUMPS

BACKGROUND OF THE INVENTION

This invention relates to the field of calibration devices and methods. More specifically, it relates to calibration systems for use in factory, industrial, medical and similar environments where there is a need to take accurate measurements involving fluids, such as air, oxygen and other gases. In many industrial applications involving pollution monitoring and process control the flow rate of a fluid and, in particular, a gas must be known to a high degree of accuracy. For that reason it is often necessary to calibrate the pump which produces the flow.

It is known to calibrate pump units using devices which are commonly referred to as bubble tubes. Soap bubbles are formed in an elongate, open ended glass tube having calibration marks thereon. The pump to be calibrated is connected to one end of the tube and the movement of the bubble in the tube as a function of time is a measure of the flow rate of the device under test.

These devices are not entirely satisfactory for a number of reasons, such as the requirement for a series of different sized tubes to accommodate different flow rate ranges, the difficulty of generating the soap bubbles and the frustration when bubbles break during measurement. Further, such measurement apparatus are messy, time consuming and not as portable as might be desired.

It is accordingly an object of the present invention to provide a new method and apparatus for calibrating the flow rate of pumps and similar devices.

It is another object of the invention to provide a method and apparatus which employ a critical orifice to precisely measure flow rates.

A further object of the invention is to provide a fluid receptacle which can be substantially completely evacuated during testing to insure accurate measurement.

A further object of the invention is to provide a portable, accurate pump calibration system which can measure the flow rate of pumps over a wide range without adjustments to measuring apparatus.

Another object of the invention is to provide an apparatus and method which fill a receptacle with a precise known volume and then accurately and automatically measure the time required to evacuate the receptacle thereby to obtain a measurement of the flow rate.

A further object is to integrate unknown flow rates over a period of time to obtain accurate results.

Other objects and advantages of the invention will be apparent from the remaining portion of the specification.

DETAILED DESCRIPTION

Figure 1:
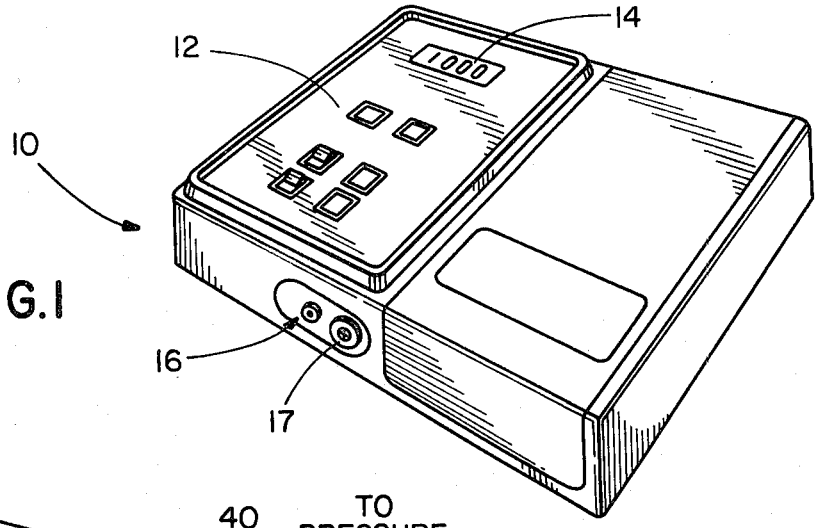
FIG. 1 is a perspective view of the apparatus according to the invention in a portable case.
Figure 2:
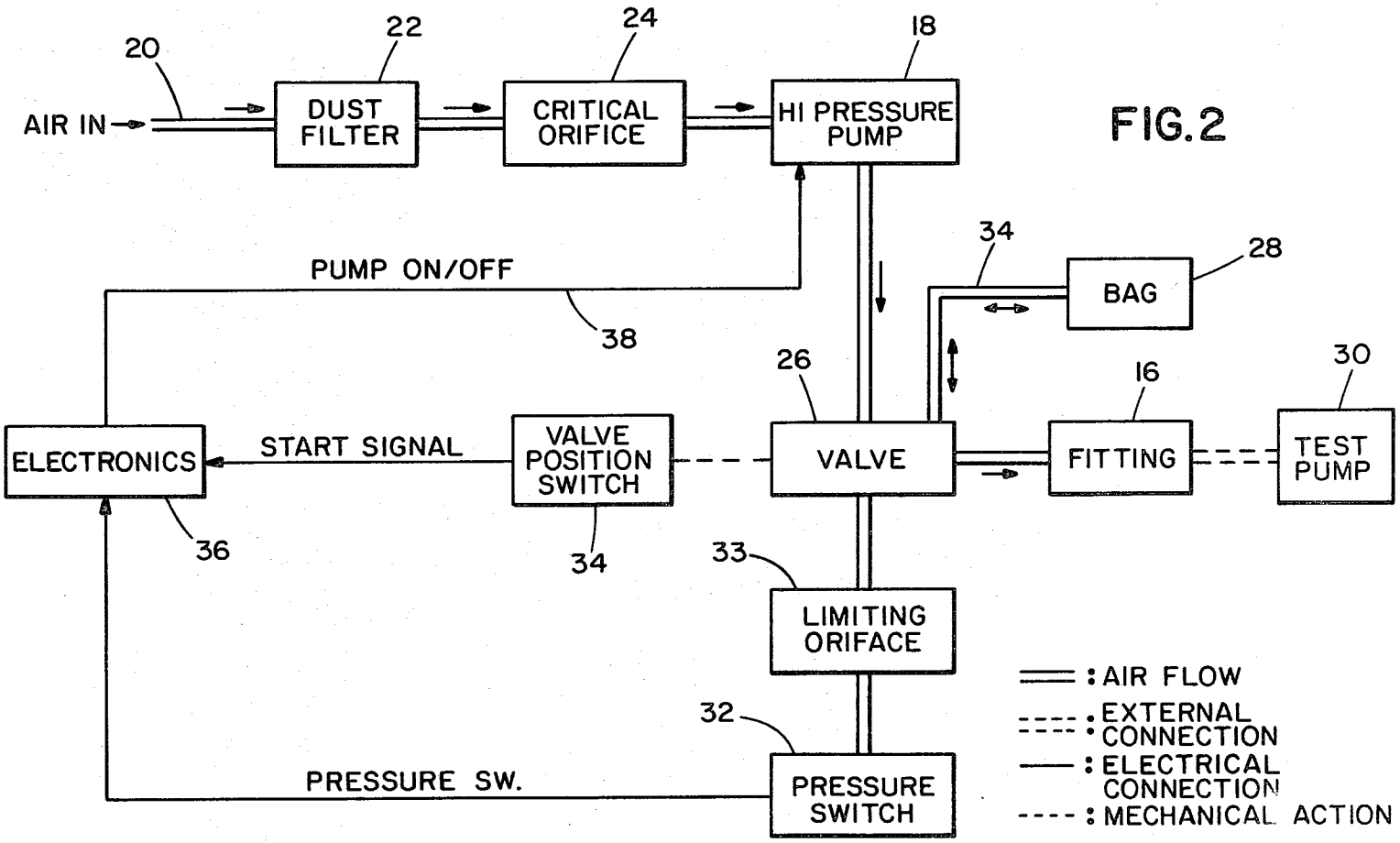
FIG. 2 is a block diagram of the system indicating the principal element thereof.

Referring to FIGS. 1 and 2, the apparatus of the invention is shown. Preferably the device 10 is contained in a lightweight portable housing. The top portion thereof has a control panel 12 including a digital display 14 and a number of switches, the purpose of which is explained hereafter. On one side of the unit is a fitting 16 for connecting a pump to be calibrated thereto. Housed within the right side of the case is a receptacle or bag into which air or other gas is pumped and evacuated during the operation of the device. A knob 17 is associated with a valve for a purpose to be described.

With particular reference to FIG. 2, the principal elements of the invention are shown. Contained within the housing is a high pressure pump 18 which is supplied with a fluid, such as air, from an intake 20 via a dust filter 22 and a critical flow orifice 24. When required, the pump 18 supplies air under pressure through a compound valve 26 to a bag or receptacle 28.

As detailed hereafter, after the bag 28 is filled with a known volume of air, the compound valve 26 is switched so that the bag 28 is disconnected from the pump 18 and connected instead, via the external fitting 16, to a pump under test 30. The test pump evacuates the air in the bag 28. Since the volume of air in the bag 28 is known, by virtue of the manner in which it has been filled by the pump 18, the flow rate of the pump can be determined by timing the period required for the test pump to evacuate the bag.

The state of the bag 28 is monitored by a pressure switch 32 connected through a limiting oriface 33, valve 26 and line 34 through which the bag communicates with the valve. The pressure switch 32 detects when the bag is substantially evacuated. The limiting oriface 33 performs damping and linearizing functions to increase the accuracy of the pressure switch.

A valve position switch 34 is mechanically linked to the valve 26. This switch provides a signal to the electronics 36 at the time the valve is switched to start evacuation of the bag 28.

CRITICAL FLOW ORIFICE 24

A significant aspect of the present invention is the use of a critical flow orifice 24 in conjunction with the high pressure pump 18. As is known by those skilled in the art, an increase in pressure across an orifice of a known cross sectional area is accompanied by an increase in flow rate through the orifice up to a limit. As the pressure across an orifice is increased beyond the limit a critical region is encountered wherein further increases in pressure result in insignificant changes in flow rate through the orifice. Thus, there exists a maximum flow rate for an orifice of known cross sectional area. The present invention uses this critical region principal to obtain a precise, constant flow of air to fill the bag 28 with a known volume to an accuracy on the order of one-half of one percent.

Figure 5:
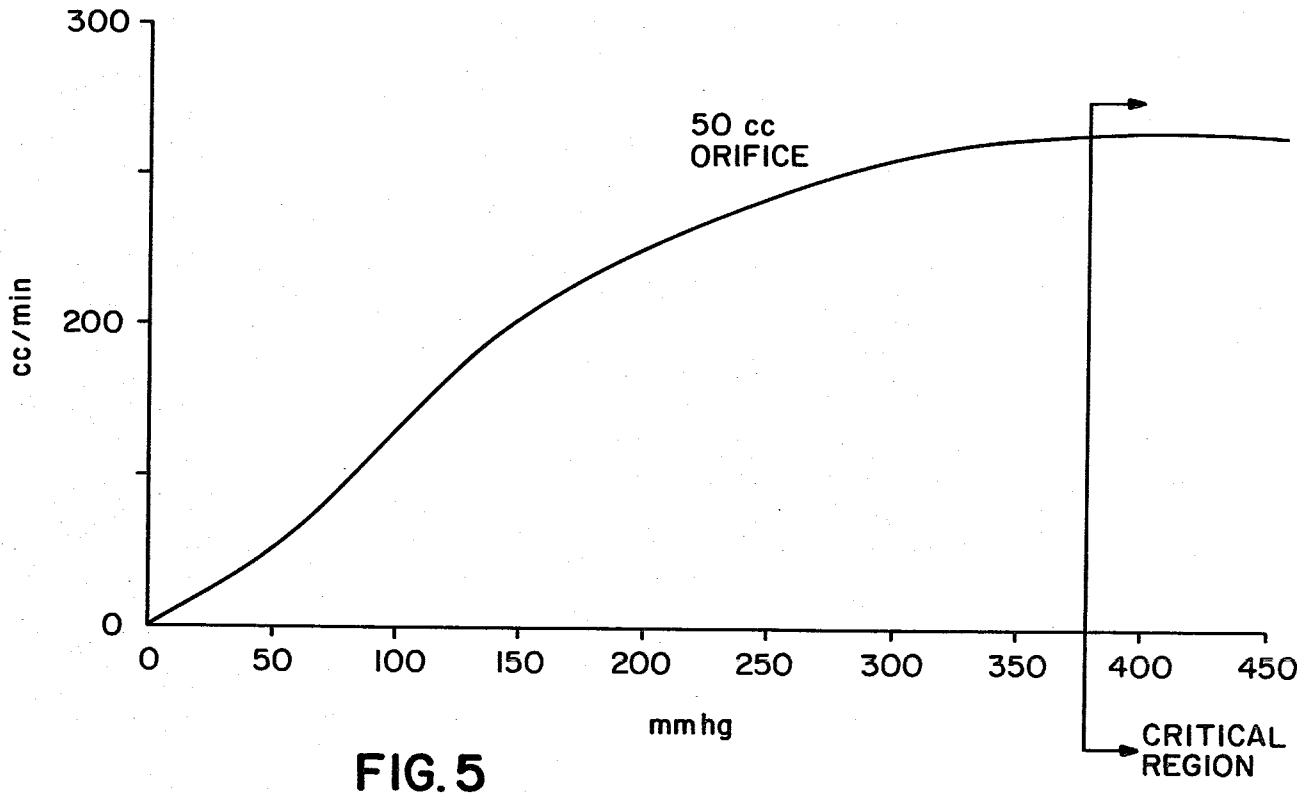
FIG. 5 is a generalized graph of flow rate versus pressure useful in understanding critical flow orifice operation.

A detailed discussion of critical flow orifice theory is unnecessary for an understanding of the invention. However, such information is contained in a number of available references, such as the Standard Handbook for Mechanical Engineers, Seventh Edition, McGraw-Hill, section 4-62 et seq. With reference to FIG. 5, a generalized flow rate versus pressure diagram is illustrated.

The vertical axis is flow rate in cc/min while on the horizontal axis pressure in mmHg is shown. For an orifice having a specified cross sectional area it can be seen that until the critical region is reached every increase in pressure produces a corresponding increase in flow rate. In the critical region, however, further increases in pressure result in almost no increase in flow rate through the orifice. It is this aspect of orifice theory which is employed to advantage in the present invention.

By way of example only a 50 cc limiting orifice will be in the critical region at pressures greater than about 380 mmHg with a maximum flow rate of about 250 cc/min.

HIGH PRESSURE PUMP 18

The critical orifice 24 is preferably located on the input side of the high pressure pump 18 although, of course, the two elements can be reversed with good results. The pump can be of any commercially available type, such as manufactured by Romega. The essential criterion is that it be able to generate pressures sufficient to maintain the orifice 24 in the critical region as illustrated in FIG. 5. A desirable feature of the pump is that it be small and efficient so that it may be battery operated in order to produce the portable unit illustrated in FIG. 1. As indicated in FIG. 2, the pump is controlled by the electronic package 36 via an on/off line 38.

VALVE MECHANISM 26

Figure 3:
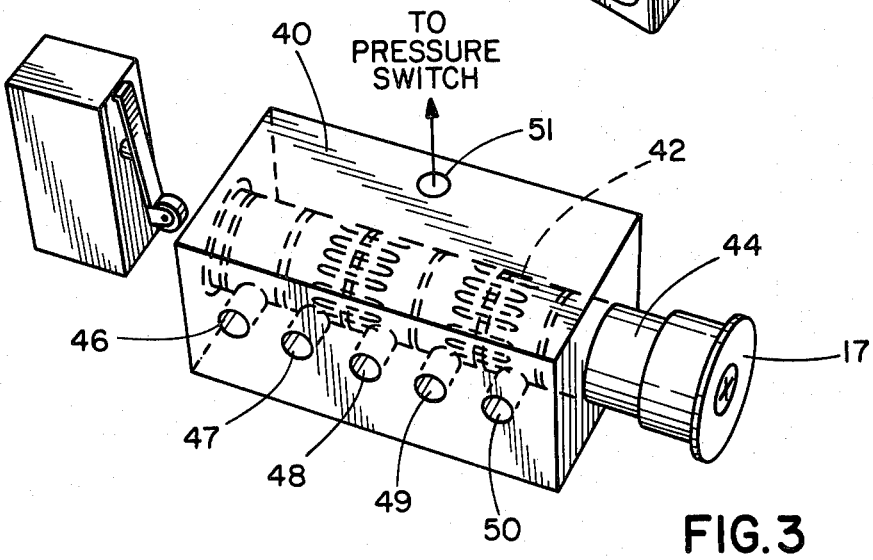
FIG. 3 is a perspective view of the valve mechanism according to the invention.

Referring to FIG. 3, the valve mechanism is illustrated. It will be apparent to those skilled in the art that any valve mechanism which performs the functions specified hereafter is suitable for use in the invention. In FIG. 3, however, there is illustrated a preferred valve arrangement for the invention. The valve includes a block 40 which may be formed of plastic or similar materials. A cylindrical opening 42 is drilled longitudinally through the block. The cylinder 42 receives therein a piston member 44 which member can reciprocate in the cylinder between two positions.

A plurality of openings 46, 47, 48, 49 and 50 are drilled into the side of the block 40 to communicate with the cylinder 42. A similar opening 51 is provided on the top of block 40. Opening 51 communicates with opening 48 by virtue of a transversely oriented cylindrical recess provided in the block (not shown for clarity).

The piston 44 is slidably mounted in the cylinder and functions to connect selected openings one to the other. For that purpose the piston has channels or grooves (not shown) cut into its circumference to communicate different pairs of openings depending on position. Thus, in the position illustrated in FIG. 3, openings 49 and 50 are interconnected as are openings 47 and 48. Opening 46 is blocked off in this position. Opening 51 is similarly situated with opening 48 and thus it is interconnected to openings 47.

In the alternate position piston 44 interconnects openings 46 and 47 while sealing opening 50. In addition, openings 47, 48 and 51 are interconnected. In this second position the end of the piston extends from the left side of the block and engages the valve position switch 34. When the piston 44 is moved from the position shown in FIG. 3 to the alternate position switch 34 is actuated which, as illustrated in FIG. 2, provides a start signal to the electronic 36 indicating that the test pump is connected to the bag 28.

VALVE CONNECTIONS

Opening 46 is vented to the atmosphere and serves the purpose of discharging the high pressure pump 18 during the time that the test pump is emptying the bag 28. The high pressure pump 18 is connected to opening 47. As described, openings 47 and 46 are interconnected when the piston 44 is in the alternate position thus providing the venting operation.

Opening 48 is connected, via the conduit 34, to the bag 28. Opening 49 is connected, via the fitting 16, to an external pump under test, as indicated at 30 in FIG. 2. Opening 50 is open to the atmosphere for venting the test pump during the period that the high pressure pump is inflating bag 28 and the piston is in the FIG. 3 position. Opening 51 is connected to the pressure switch 32 which detects when the bag has been emptied by the test pump.

Having specified these connections it will be readily apparent that in the FIG. 3 position the high pressure pump 18 is connected to the bag 28 via openings 47 and 48 in the valve. The test pump is connected via openings 49 and 50 to the atmosphere. In the alternate position the high pressure pump is vented to the atmosphere via opening 46 while the test pump is connected to the bag via openings 48 and 49 while the pressure switch 32 monitors the bag pressure via opening 51.

AIR BAG 28

Figure 4:
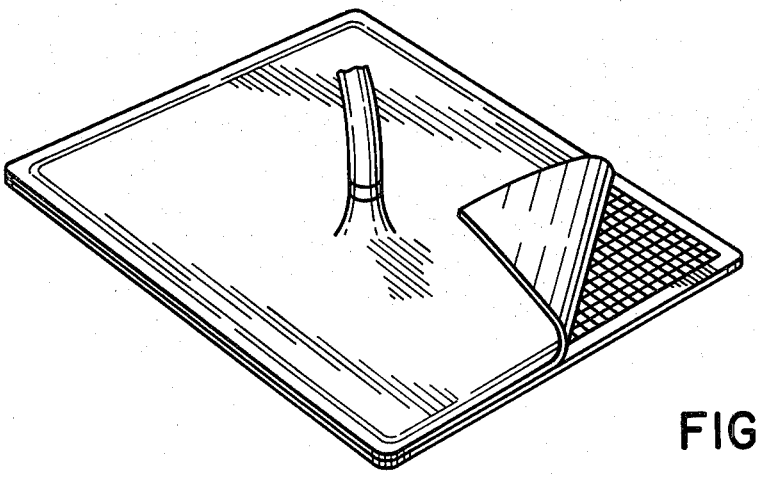
FIG. 4 is a perspective view of the air bag or receptacle.

Referring now to FIG. 4, a receptacle or bag 28 suitable for use in the invention is illustrated. The bag must, of course, be air tight except for an opening for connected to the conduit 34. An important requirement for the bag is that it permit uniform evacuation of air without trapping any air therein. Falure to do so, of course, would result in inaccurate measurement of the period of time required to evacuate air therefrom by the test pump.

According to the invention the receptacle 28 is preferably formed from two flat sheets of plastic, such as polyvinyl chloride which are laminated, heat sealed or otherwise joined at the ends thereof. The interior of the receptacle is provided with a "porous" element, such as a swatch of cotton fabric or preferably plastic mesh or screening. This element insures uniform evacuation of the receptacle as the plastic walls thereof come together. The porous element prevents trapping of air in pockets formed by receptacle wall contact which would lead to the aforementioned inaccuracies. The cloth or screening maintains the receptacle walls sufficiently spaced to permit all of the air to be evacuated therefrom due to the porous nature of the cloth or the lattice work of the screening.

ELECTRONICS

Figure 6:
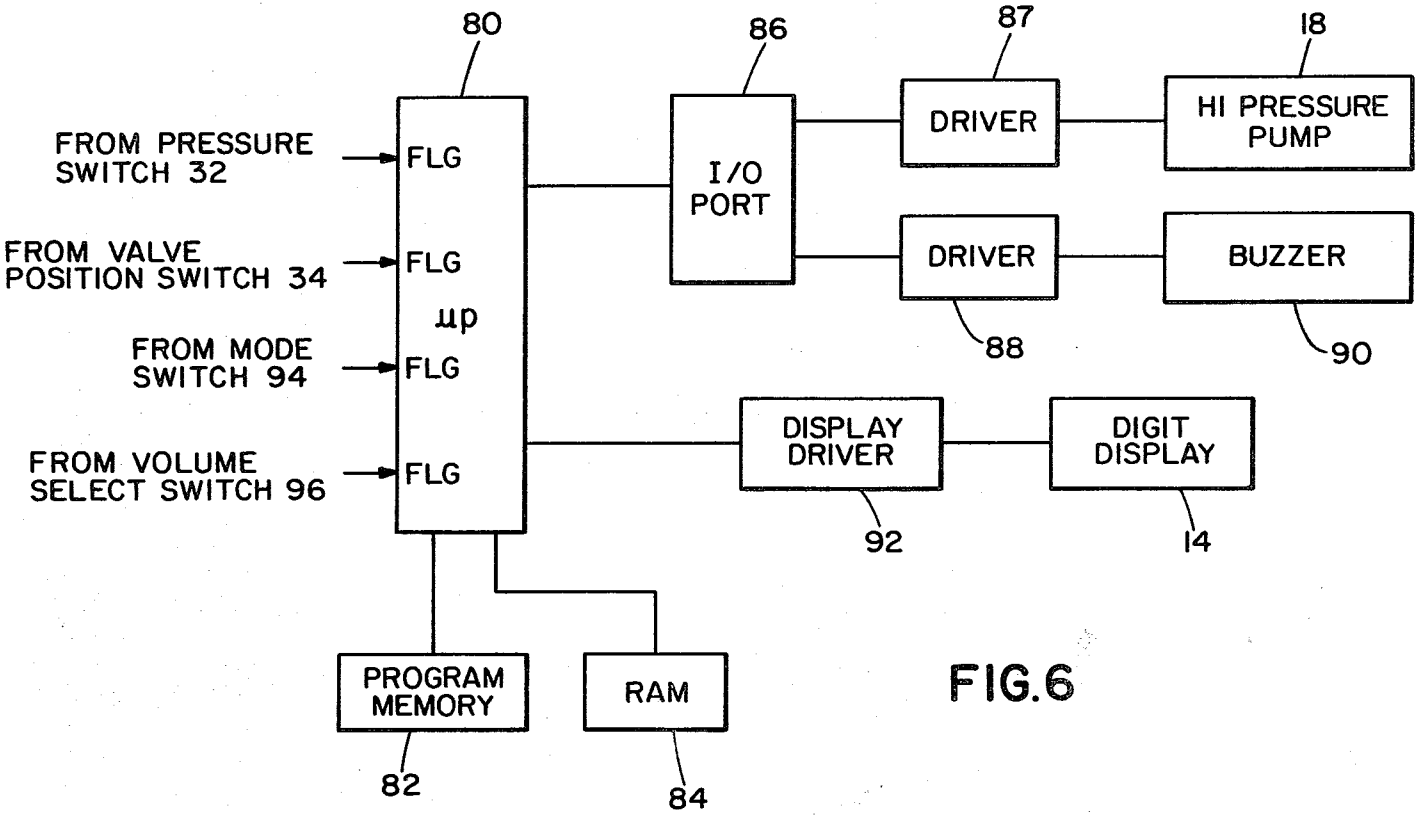
FIG. 6 is a block diagram of the electronic control system according to the invention.

Referring to FIG. 6, a block diagram of the electronics for the invention is illustrated. The electronics system consists of a microprocessor 80 and associated program memory 82 and random access memory (RAM) 84, an input/output port 86 and driver circuits 87 and 88 for operating the high pressure pump 18 and a buzzer 90 or similar audible signal. In addition, the microprocessor operates a display driver 92 and the associated digit display 14.

There are a number of microprocessors on the market suitable for use in the invention, such as those manufactured by Motorola and RCA. In particular, an RCA microprocessor designated CDP 1802 is suitable for this purpose. Such a unit includes a number of external flag inputs, four of which are used in the present invention to receive the switch input shown in FIG. 6. Specifically, the pressure switch 32, the valve position switch 34, a mode switch 94 and a volume select switch 96 are provided as inputs to the microprocessor. Under program control the microprocessor operates the pump, buzzer and digit displays as detailed hereafter.

As previously explained, the pressure switch 32 signals the microprocessor when the bag 28 has been evacuated by the test pump 30. The microprocessor can then determine the flow rate of the pump from the period of time required to accomplish the evacuation. The valve position switch 34 signals the microprocessor of the precise moment when the evacuation of the bag 28 begins. Mode switch 94 permits the user to operate the device in one of two modes. In the first mode designated "program volume" the user can select the volume of air which the high pressure pump 18 will place into the receptacle 28. Depending upon the size of the pump to be tested different quantities of air will be desired to permit operation sufficient to obtain reliable data. By way of example only the microprocessor can be programmed to cause from 20 to 500 cc of air to be pumped into the receptacle.

While in the program volume mode the user indicates the desired volume by operating the volume select switch 96. Each operation of switch 96 will cause the computer to increment the program volume and display the current quantity on the digit display 14.

OPERATION

When the user has selected the desired volume of air the mode switch 94 is moved to its second position referred to as the "test position". Moving the mode switch 94 to the test position initiates operation of the unit for purposes of calibrating the test pump 20. The microprocessor, via the I/O port 86 and driver 87, turns on the high pressure pump 18. With the valve 26 in the position shown in FIG. 3 the pump supplies air to the bag 28 at a rate which is predetermined by virtue of the critical orifice 24. The microprocessor is provided with a highly accurate quartz crystal clock and is programmed to monitor the operation of the high pressure pump to precisely fill the bag 28. When the bag is filled with the selected volume of air the pump 18 is disabled and the system then goes into a stand by mode.

The test pump 30 is connected to the fitting 16 and turned on. The user begins the calibration process by initiating evacuation of the bag 28 by operating the valve 26 to move it to its second position. In the second position the bag is connected through the valve and fitting to the test pump and evacuation commences. This fact is communicated to the microprocessor by the valve position switch 34 causing the microprocessor to begin timing the evacuation operation. Timing continues until the pressure switch 32 signals the microprocessor that the bag is empty. The final step required is the routine calculation of flow rate based on a known volume of air in the bag and a known time to evacuate it. The microprocessor, of course, performs this calculation and displays the result on the digit display 14.

The present invention utilizes microprocessor electronics to operate a high capacity pump which provides sufficient pressure to place an orifice of known size in the critical operating region. The use of the quartz crystal time base associated with the microprocessor accurately measures the starting and stopping time of the pump under test. The accuracy of this invention has been empirically determined to rival the accuracy of expensive laboratory bubble tubes.

The audible tone or buzzer 90 is employed by the microprocessor to signal the operator at various points in the procedure as, for example, when the test pump has evacuated the bag. Also, the buzzer may be activated after the bag has been filled to advise to the user to move the valve to the second position to initiate evacuation of the bag.

It will be apparent that the device can be powered from an AC current source if desired or, as is preferred, the circuit is suitable for battery operation with a rechargeable gel cell of the type currently available. The referenced RCA microprocessor is a low current type which is ideally suited for battery operation.

While we have shown and described embodiments of this invention in some detail, it will be understood that this description and illustrations are offered merely by way of example, and that the invention is to be limited in scope only by the appended claims.

We claim:

1. A method of determining the flow rate of a pump under test comprising the steps of:
   (a) pumping fluid into a receptacle for a selected period of time via an orifice having a known maximum flow rate, said fluid being under sufficient pressure to maintain the said maximum flow rate through said orifice so that the volume of fluid pumped into the receptacle during said selected time period is known;
   (b) evacuating the receptacle using the pump under test;
   (c) measuring the time period required to perform step (b);
   (d) calculating the flow rate of the pump under test from the known volume of fluid evacuated and the time period required to perform step (b).

2. The method of claim 1 wherein step (a) includes the substeps of:
   (i) operating a high pressure pump to draw fluid through said orifice and provide it to said receptacle;
   (ii) timing the period of operation of said high pressure pump.

3. The method of claim 2 further including the steps of:
   (i) providing a two position valve which communicates said high pressure pump to said receptacle in a first position and communicates said pump under test to said receptacle in a second position;
   (ii) switching the valve from the first position to the second position after the selected time period.

4. Apparatus for determining the flow rate of a pump under test comprising:
   (a) a fluid receptacle;
   (b) an orifice having a known maximum flow rate;
   (c) means for pumping fluid via said orifice into said receptacle under sufficient pressure to maintain the maximum flow rate through said orifice;
   (d) means for alternately connecting one of said pumping means and said pump under test to said receptacle whereby the receptacle is filled by said pumping means and evacuated by the pump under test;
   (e) control means for operating said pumping means for a selected time period whereby the volume of fluid in the receptacle is known and for measuring the time required for the pump under test to evacuate the receptacle and calculating the flow rate of the pump under test from the known volume of fluid evacuated from the receptacle and the time required to evacuate it.

5. The apparatus of claim 4 wherein said fluid receptacle comprises:

(a) a closed, fluid impermeable bag having a fitting therethrough to permit filling and evacuation of said bag;

(b) means disposed in said bag for ensuring substantially complete evacuation of said bag by preventing fluid from being trapped therein.

6. The apparatus of claim 5 wherein said means disposed in said bag is a fluid permeable mesh.

7. The apparatus of claim 4 wherein said pumping means includes:

a fluid pump capable of drawing fluid through said orifice at the maximum flow rate when enabled by said control means.

8. The apparatus of claim 4 wherein said connecting means is a valve arrangement movable between first and second positions, said valve arrangement connecting said pumping means to said receptacle in the first position and the pump under test to the receptacle in the second position.

9. The apparatus of claim 4 wherein said control means includes:

(a) means for selecting and timing the period of operation of said pumping means;

(b) circuit means for operating said pumping means for the time period determined by said selecting and timing means.

10. The apparatus of claim 4 wherein said control means includes:

(a) means for detecting when the pump under test begins to evacuate the receptacle;

(b) means for detecting when the pump under test has substantially evacuated said receptacle;

(c) means responsive to elements (a) and (b) of this claim for determining the period of time the pump under requires to evacuate said receptacle.

11. The apparatus of claim 10 wherein said means for detecting when the pump under test has substantially evacuated said receptacle is a pressure switch in communication with said receptacle, said switch signalling said control means when the receptacle has been substantially evacuated.

12. The apparatus of claim 4 wherein said control means includes means for signalling the operator when the receptacle is filled with said known volume of fluid and when the receptacle has been substantially evacuated.

13. The apparatus of claim 4 wherein said apparatus includes a digit display and said control means provides the calculated flow rate of the pump under test on said display.

14. Apparatus for detecting the flow rate of a fluid evacuated from a receptacle comprising:

(a) a fluid receptacle;

(b) an orifice having a known maximum flow rate;

(c) means for pumping fluid via said orifice into said receptacle under sufficient pressure to maintain the maximum flow rate through said orifice;

(d) means connecting said pumping means to said receptacle in a first position and disconnecting said pumping means to permit evacuation of said receptacle in a second position;

(e) control means for operating said pumping means for a selected time period whereby the volume of fluid in the receptacle is known and for measuring the time required to substantially evacuate the receptacle and calculating the flow rate of the pump under test from the known volume of fluid evacuated from the receptacle and the time required to evacuate it.

* * * * *